US007404222B2

(12) United States Patent
Tidwell

(10) Patent No.: US 7,404,222 B2
(45) Date of Patent: Jul. 29, 2008

(54) SUPPORT PILLOWS WITH STRETCH PANELS

(75) Inventor: Kristin A. Tidwell, Denver, CO (US)

(73) Assignee: The Boppy Company, Golden, CO (US)

( * ) Notice: Subject to any disclaimer, the term of this patent is extended or adjusted under 35 U.S.C. 154(b) by 152 days.

(21) Appl. No.: 11/395,690

(22) Filed: Mar. 30, 2006

(65) Prior Publication Data

US 2007/0226910 A1 Oct. 4, 2007

(51) Int. Cl.
*A47G 9/00* (2006.01)

(52) U.S. Cl. ..... 5/655; 5/652

(58) Field of Classification Search ..... 5/655, 5/490, 630, 652, 636, 632, 646
See application file for complete search history.

(56) References Cited

U.S. PATENT DOCUMENTS

| | | | |
|---|---|---|---|
| 2,328,871 | A | 9/1943 | Woehler |
| 5,154,649 | A | 10/1992 | Pender |
| 5,261,134 | A | 11/1993 | Matthews |
| 5,546,620 | A | 8/1996 | Matthews |
| 5,661,861 | A | 9/1997 | Matthews Brown |
| 6,038,720 | A | 3/2000 | Matthews Brown et al. |
| 6,055,687 | A | 5/2000 | Matthews Brown |
| 6,119,873 | A | 9/2000 | Matthews Brown |
| 6,279,185 | B1 | 8/2001 | Matthews Brown |
| 6,321,403 | B1 | 11/2001 | Matthews Brown |
| 6,412,128 | B1 | 7/2002 | Matthews Brown |
| 6,434,770 | B2 | 8/2002 | Matthews Brown |
| 6,453,493 | B1 | 9/2002 | Matthews Brown |
| 6,523,200 | B2 | 2/2003 | Matthews Brown |
| 6,532,612 | B2 | 3/2003 | Matthews Brown |
| 6,625,828 | B2 | 9/2003 | Matthews Brown |
| 6,640,977 | B2 | 11/2003 | Matthews Brown et al. |
| 6,671,908 | B2 | 1/2004 | Brown et al. |
| 6,685,024 | B1 | 2/2004 | Matthews Brown |
| 6,763,539 | B1 | 7/2004 | Bartley et al. |
| 6,851,143 | B2 | 2/2005 | Matthews Brown |
| 6,857,150 | B2 | 2/2005 | Matthews Brown et al. |
| 6,892,406 | B2 | 5/2005 | Littlehorn |
| 6,944,898 | B2 | 9/2005 | Matthews Brown et al. |
| 7,000,274 | B2 | 2/2006 | Matthews Brown et al. |
| 7,000,275 | B2 | 2/2006 | Matthews Brown et al. |
| 7,000,766 | B2 | 2/2006 | Matthews Brown et al. |
| 7,017,212 | B2 | 3/2006 | Matthews Brown |
| 2002/0029422 | A1 * | 3/2002 | Matthews ..... 5/655 |
| 2004/0200004 | A1 * | 10/2004 | Matthews Brown et al. .... 5/655 |
| 2005/0015883 | A1 * | 1/2005 | Bartley et al. ..... 5/655 |

* cited by examiner

*Primary Examiner*—Frederick L Lagman
(74) *Attorney, Agent, or Firm*—Townsend and Townsend and Crew LLP

(57) ABSTRACT

In one embodiment, a support pillow comprises a pillow body having a medial region and two opposing arms that form a well region, a first side and a second side. The pillow body further includes an outer periphery and an inner periphery outlining the well region. The pillow body further comprises a fill material and a cover enveloping the fill material. The cover comprises a main section that extends about the first and second sides and the outer periphery, and a center panel coupled to the main section so as to be located along the inner periphery. Also, the center panel is constructed of a stretchable material and has a variable width.

18 Claims, 7 Drawing Sheets

SUPPORT PILLOWS WITH STRETCH PANELS

BACKGROUND OF THE INVENTION

This invention relates generally to the field of support pillows and, in particular, to support pillows that are intended to be placed around a variety of differently sized objects. More specifically, the invention relates to support pillows that may be manipulated to different configurations and automatically spring back to their original shape.

Over the years, a variety of support pillows have found commercial acceptance. Once exemplary support pillow is the Boppy® pillow, marketed by The Boppy Company. Various forms of this pillow are described in U.S. Pat. Nos. 5,261,134, 5,546,620, 5,661,861, and 6,055,657, among others. The complete disclosures of these patents are incorporated herein by reference.

Another exemplary pillow is described in U.S. Pat. No. 6,412,128, which is incorporated herein by reference. Such a pillow includes a cover with an inner strip of material which permits the arms to be separated without tearing or damaging the cover. This invention provides various improvements to similar types of support pillows, permitting convenient separation of the arms while allowing them to spring back to their starting position.

BRIEF SUMMARY OF THE INVENTION

The invention provides various support pillows that are useful with different sized adults as well as with babies. In one embodiment, such a pillow is constructed of a pillow body having a medial region and two opposing arms that form an open well region. The pillow body may also be defined in terms of first and second sides, an outer periphery, and an inner periphery outlining the well region. The pillow body is further constructed of a cover which holds a fill material. The cover is constructed of a main section that extends about the first and second sides and the outer periphery. Also, a center panel is coupled to the main section and lies along the inner periphery. In one embodiment, the center panel may be constructed of a stretchable material that permits the arms to be separated from each other by a wide degree and then spring back to their original position. In this way, the support pillow may be manipulated to be placed about the waist or torso of an adult or larger individual without permanently distorting or altering the shape of the pillow. Further, after use, the arms spring back to their original position so that the pillow may subsequently be used to support a baby while sitting, among other uses.

In another aspect, the pillow body may be constructed such that the width of the center panel is greater at the medial region than along the arms. This configuration is also useful in permitting the arms to be separated and then to spring back. In one aspect, the width of the center panel at the medial region is in the range from about 2.5 inches to about 7.5 inches. The width of the center panel may be in the range from about 1 inch to about 3.5 inches along the arms. Further the length of the center panel may be in the range from about 20 inches to about 28 inches.

In one particular arrangement, the main section may be constructed of a pair of fabric pieces that are sewn together at the outer periphery. The center panel may be sewn to the fabric pieces at the inner periphery.

The center panel may be constructed of a variety of stretchable fabrics. Stretchable fabrics that may be used include two-way and four-way stretchable fabrics, such as those sold under the trade name LYCRA. Other stretchable materials include stretchable twills, stretchable cottons, and the like.

In some embodiments, the well region may have a diameter in the range from about 4 inches to about 12 inches when the ends of the arms are touching. Also, the center panel permits the arms to be separated to the extent that the pillow body is generally straight. When released, the arms come to within at least about 8 inches of each other. Also, the center panel permits the arms to be separated so as to be at least perpendicular to the medial region with essentially no buckling of the cover at the medial region.

The support pillows may have a wide variety of uses. For example, they may be placed about the waist or torso of an adult and used to support an item, such as a baby when feeding. The pillows may also be used to support a baby when sitting by placing the baby in the open well. Other uses are possible.

DETAILED DESCRIPTION OF THE INVENTION

Figure 1:
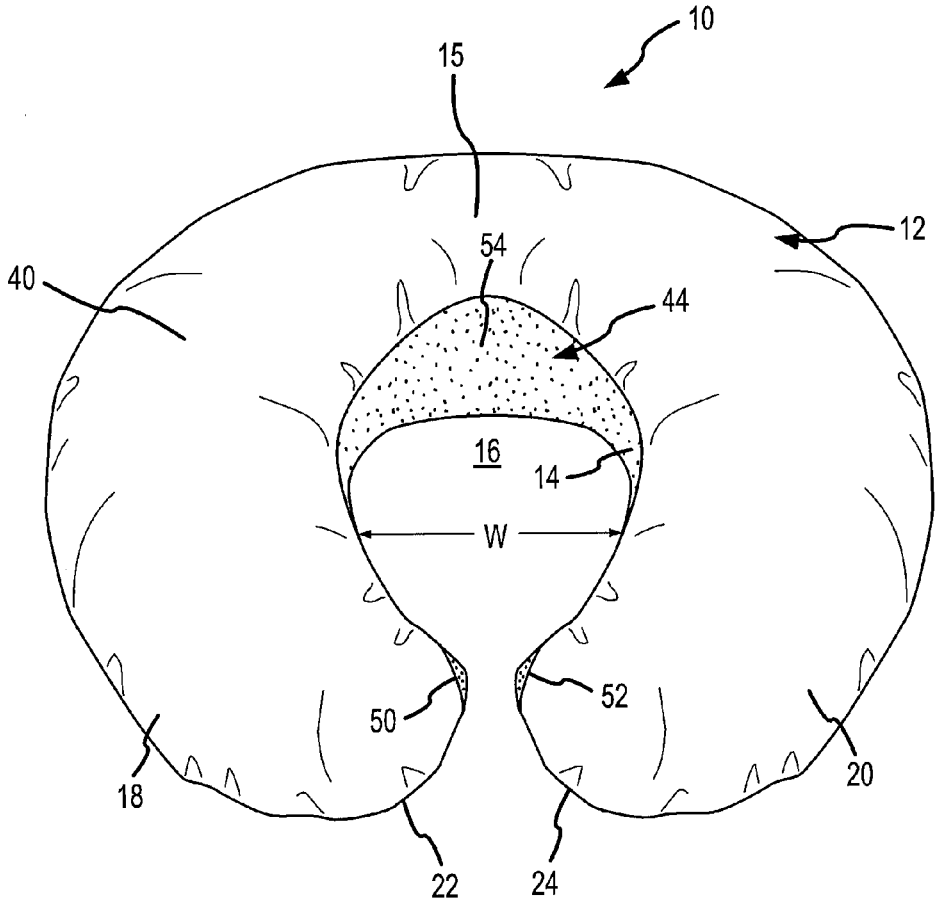
FIG. 1 is a perspective view of one embodiment of a support pillow having a stretch panel according to the invention.

The invention provides various support pillows that are constructed of a medial region and two opposing arms that may be widely separated from each other without damaging or permanently distorting the pillow. When the arms are released, they spring back to their original position. This permits the pillow to be placed about large objects, with the arms tensioned against the object, yet not uncomfortably. For example, when the ends of the arms are separated enough to be placed about the torso of an average sized adult, the inward force produced by each arm is sufficient to hold the pillow in place about the torso, yet not so tight that it is uncomfortable. Further, when the pillow clings about a relatively large object, the medial region does not buckle, but keeps its shape. When removed, the pillow's resilience permits it to spring back to its original shape, typically with the ends being separated by about 8 inches or less, and in some cases about 4 inches or less and in other cases about 2 inches or less.

To construct the pillow, a cover is used to surround a fill material. Also, the cover includes a stretch panel or central panel surrounding the open well. Optionally, the cover may be enveloped by a slip cover which may be constructed in the same manner as the cover of the pillow, or may be constructed without a stretch panel. Examples of slip covers which may be used, or which may be modified to include a stretch panel are described in U.S. Pat. Nos. 6,453,493, 6,625,828, 6,851,143, and 7,000,274, which are incorporated herein by reference.

The fill material used to make the pillow may be such that the pillow is relatively firm when filled, particularly so that the pillow will not significantly deflect under the weight of a baby. Examples of materials that may be used include polyester fibers, foamed materials, and the like. One method for filling the cover with a fill material is described in co-pending U.S. patent application Ser. No. 10/769,007, filed Jan. 29, 2004, which is incorporated herein by reference.

The cover may be constructed of a main portion using one or more pieces of a generally non-stretchable fabric and a stretch or center panel at the inner periphery of the pillow. The overall shape of the pillow may be similar to those described in U.S. Pat. Nos. 5,261,134, 5,661,861, 5,546,620 and 6,055,687, which are incorporated herein by reference. The main portion of the cover may, in some cases, be constructed of two pieces of material which are sewn to each other, with the stretch panel being sewn to the main portion, although other coupling techniques may be used, such as by using a fabric glue. One technique for attaching a center piece of material to a cover is also described in U.S. Pat. No. 6,412,128, which is incorporated herein by reference. The non-stretchable material used to construct the main portion of the cover may be a fabric, such as cotton, polyester, velvet, and the like. Such non-stretchable fabrics permit the pillow to be firmly stuffed with fill materials. When stuffed in this manner, the pillows are able to maintain their shape for extended time periods. Such fabrics also provide an aesthetically pleasing surface.

The support pillows of the invention may find use with a variety of applications where the arms are manipulated to be placed around an object. Merely by way of example, such applications may include placement about a torso to facilitate nursing, the holding of an object, such as a book, a toy, food, or the like, to function as a back support, or the like. The support pillows of the invention may also find use with the applications described in U.S. Pat. Nos. 5,661,861, 5,546,620, 5,261,134, and 6,055,687, previously incorporated herein by reference.

The center panel may be configured in a variety of ways in order to permit the arms to be separated and then spring back. One way is by making the center panel of a stretchable material while the rest of the cover is non-stretchable. Another way is through the shape of the center panel which may be wider at the medial region than it is along the arms. In some cases, both techniques may be used together so that the center panel is both stretchable and has a wide portion at the medial region. The width of the medial region may be critical in ensuring that the pillow arms may be widely separated while still providing sufficient spring in the arms so that they can cling about an object and also move back to their original position.

Figure 2:
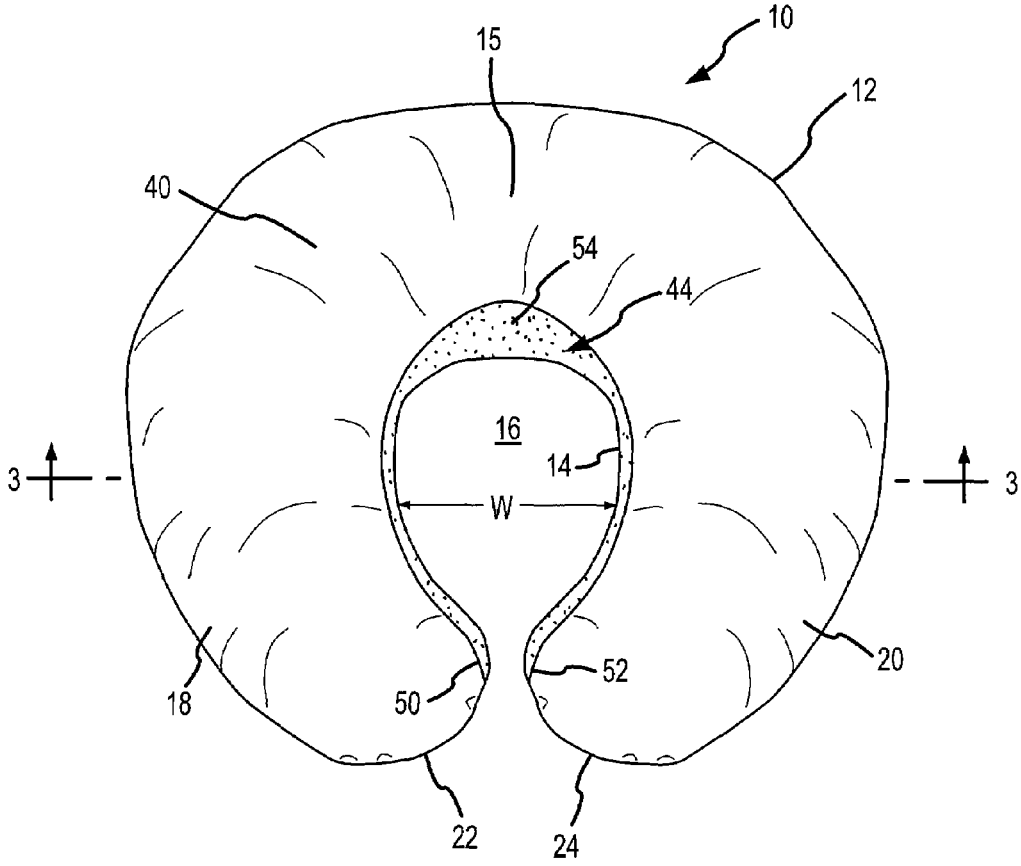
FIG. 2 is a top view of the pillow of FIG. 1.
Figure 3:
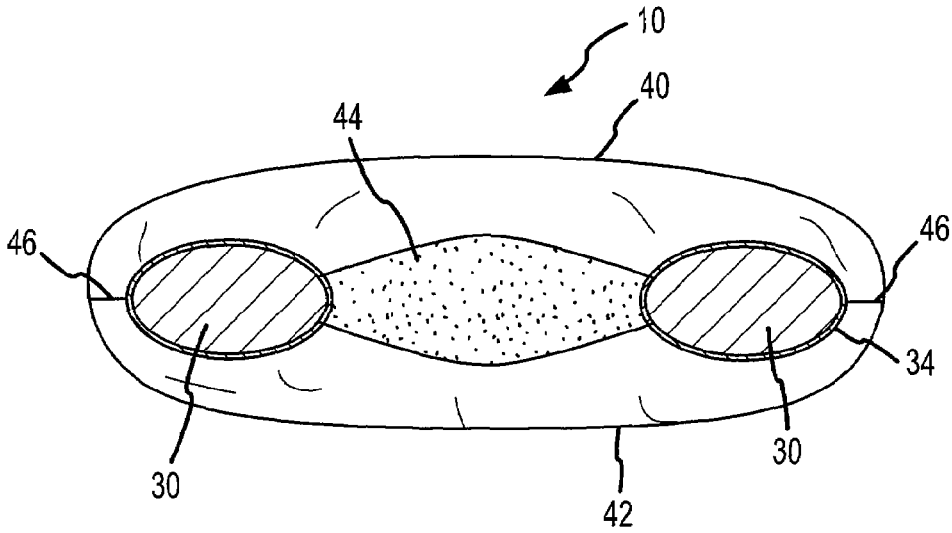
FIG. 3 is a cross-sectional view of the pillow of FIG. 2 taken along lines 3-3.

Referring now to FIGS. 1-3, one embodiment of a support pillow 10 will be described. Pillow 10 may be constructed to have an overall shape and feel that are similar to the support pillows described in U.S. Pat. Nos. 5,661,861, 5,546,620, 5,261,134 and 6,055,687, previously incorporated herein by reference. However, the invention is not intended to be limited to only such support pillows, but may be used with essentially any type of pillow having two arms that may be separated from each other. Support pillow 10 includes a curved outer surface or periphery 12 which is rounded in both a longitudinal and a lateral direction to form an outer periphery. Support pillow 10 further includes a curved central inner surface or periphery 14 which defines a rounded, generally circular, curved or elliptical well region 16. While the body of the support pillow 10 is substantially continuous and uniform, with curved surfaces 12 and 14 also being continuous, it is convenient to consider the pillow body as having a medial region 15 and two opposing arms 18 and 20. The arms 18 and 20 extend in opposite directions away from the medial region 15, but are curved towards one another to give the pillow 10 its overall curved configuration. While the continuous structure does not provide a precise or exact division between the medial region 15 and each arm, considering the body of the pillow in view of these components facilitates a description of the structure and function of the pillow 10.

Arms 18 and 20 include respective blunt ends 22 and 24, positioned remotely of the medial region 15. Support pillow 10 is proportioned so that ends 22 and 24 normally, i.e., when not under external stress, touch or are slightly separated from each another, typically within about 8 inches, usually within about 4 inches and in some cases within about 2 inches of each other. However, ends 22 and 24 do not exert substantial pressure against each other, if touching. Pillow 10 has a bilateral symmetry with respect to a central plane which passes vertically through medial region 15. Pillow 10 is also symmetrical about a mid-plane which horizontally bisects the pillow body.

Well region 16 has a width W (see FIG. 2). The width W is selected to permit the support pillow to fit "snug" around the torso or waist of most users, especially babies. The pillow 10 is also constructed so that the arms 18 and 20 may be moved away from each other to vary the width W so that the pillow 10 may be used in a variety of applications, including larger sized adults.

Referring to FIG. 3, pillow 10 includes a central core 30 which may be constructed of a fill material, such as a hypoallergenic polyester filling. The central core 30 is encased by a cover 34. The majority of cover 34 is constructed of a material that is compliant while generally not stretchable. Examples of such fabrics include cotton, polyesters or other pliant conforming fabrics. The fill material is firmly and tightly packed into cover 34, such that the core 30 and cover 34 together provide a self-supporting pillow body, i.e., the support pillow 10 retains its shape without any sagging or drooping of arms 18 and 20 when held at the medial region 15. The tightly packed fill material forming core 30 also provides the pillow with firmness in the sense that it will undergo only slight elastic deformation (as compared to a conventional pillow) when an object (such as a persons' arms or elbows) is rested on the arms 18 and 20 or medial region 15. Other fill materials that could be used include natural or synthetic fibers, synthetic beads, feathers, foam, and organic granular fill materials such as husks and seeds and the like.

In the embodiments shown, cover 34 is formed of three pieces of fabric: a top piece 40 (which forms a top surface), a bottom piece 42 (which forms a bottom surface), and a center panel 44. Top piece 40 and bottom piece 42 are sewn together at the outer perimeter to form a seam 46 (see FIG. 3). Although shown with top piece 40 and bottom piece 42, it will be appreciated that a single piece of fabric Or multiple pieces) may be used to cover the top and bottom of the pillow. Sewn to top piece 40 and bottom piece 42 is center panel 44. In this way, center panel 44 surrounds the inner well 14 and eliminates a seam running along the mid-plane. Although the pieces may be sewn together, other techniques may also be used, such as by using glue, staples, snaps and the like. Center panel 44 permits arms 18 and 20 to be separated without tearing or bunching of the fabric that is adjacent the inner well 14. Further, the configuration the center panel 44 makes the pillow sufficiently resilient to spring arms 18 and 20 back to their original shape. Also, the center panel 44 is configured to provide a sufficient inward force on arms 18 and 20 so that they securely hold pillow 10 about an object, without being uncomfortable.

Center panel 44 may be constructed in a variety of ways to provide such features. One way is the material used for the center panel 44. More specifically, center panel 44 may be constructed of a stretchable material while the rest of cover 34 is formed of a generally non-stretchable material. For example, the stretchable material may comprise a two-way stretch material, a four-way stretch material, a stretch twill, a stretch cotton and the like. Two and four way stretch materials include those sold under the trade name LYCRA. Examples of materials that may be used for top piece 40 and bottom piece 42 include cotton fabrics, polyester fabrics, cotton/poly blends and the like. By using a non-stretchable material for the top piece 40 and bottom piece 42, various conventional fabrics may be used to provide a comfortable, decorative and aesthetically pleasing surface. At the same time, the stretchable material used for center piece 44 allows arms 18 and 20 to be extended as previously described. In some cases, it will be appreciated that top piece 40 and bottom piece 42 could also be constructed of a stretchable material.

The stretchable material used for center piece 44 may be configured to stretch by an amount in the range from about 15% to about 40%, and in some cases from about 20% to about 35%. Some exemplary fabrics are two way stretch fabrics that stretch about 25% and a four way stretch fabric that stretches about 32%.

The center piece 44 may be provided in essentially any color, such as nude, white, cream, pale pink and the like. Optionally, a lace overlay may be provided for decoration.

Another way to provide the functions described herein is through the shape of center panel 44. In one embodiment, center panel 44 has two ends 50 and 52 and a center section 54. Center panel 44 increases in width from ends 50 and 52 toward center section 54. The increase in width may be in the range from about 0.5 inches to about 7 inches.

Figure 4:
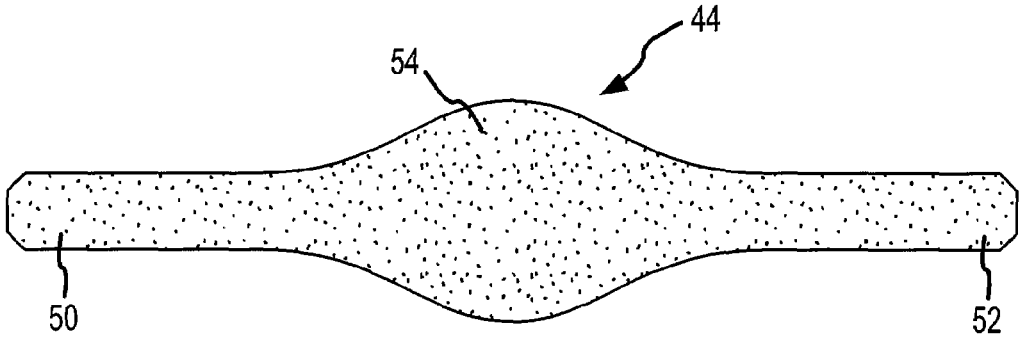
FIG. 4 illustrates the stretch panel of the pillow of FIG. 1.

FIG. 4 FIG. 4 illustrates center piece 44 separate from the cover. Center piece 44 may have a width at ends 50 and 52 that is in the range from about 1 inch to about 3.5 inches, and in some cases about 1 inch. The length of center piece 44 is about in the range from about 20 inches to about 28 inches, and in some cases about 26.5 inches. The width of center piece 44 at center section 54 may be in the range from about 2.5 inches to about 7.5 inches, and in some cases about 4.5 inches to about 5.5 inches. Also, the width of center piece 44 may begin to increase within about 4 inches to about 9 inches of ends 50 and 52 and in some cases within about 6 inches to about 8 inches.

Such dimensions for center piece 44 are particularly useful when pillow 10 includes a well 16 having a diameter of about 4 inches to about 12 inches, in some cases from about 4 inches to about 8 inches, and in other cases from about 5.5 inches to about 6.5 inches when the ends of the arms 18 and 20 are touching. The vertical height of the medial region 15 (when the pillow is lying flat) may be in the range from about 4 inches to about 10 inches, and in some cases from about 4 inches to about 5.5 inches. The height of the arms 18 and 20 at their ends 22 and 24 may be in the range from about 1 inch to about 6 inches, and more preferably from about 2 inches to about 4 inches. The horizontal thickness of the arms 18 and 20 and medial region 15 (when the pillow is lying flat) may be in the range from about 4 inches to about 10 inches, and in some cases from about 4 inches to about 8 inches. The inner periphery of the pillow may be in the range from about 15 inches to about 45 inches, and in some cases from about 22 to about 30 inches, and in some cases about 26 inches. The outer periphery of the pillow may be in the range from about 54 inches to about 74 inches and in some cases about 64 inches.

As best shown in FIGS. 1 and 3, the increased width at center section 54 permits center panel 44 to extend up the inner periphery 14 and onto the top and bottom surfaces at medial region 15. This configuration permits arms 18 and 20 to be extended from each other as described herein. Also, such a configuration substantially prevents bunching or buckling of the fabric of top and bottoms pieces 40 and 42 at medial region, even when arms 18 and 20 are opened such that they are generally perpendicular to medial region 15.

In some cases, pillow 10 may be constructed so that center panel 44 is fabricated of both a stretchable material and a shape having a width that increases at medial region 15. Also, in some cases, center panel 44 could be constructed partially of a stretchable material and a non-stretchable material.

Center panel 44 permits pillow to be used both with infants and adults. Center panel 44 allows arms 18 and 20 to be easily separated and placed around the user's waist while still providing a sufficient inward force to clamp the pillow about the user's waist. In some cases, arms 18 and 20 may be separated to such a degree that pillow 10 forms a straight line. However, when released, the arms 18 and 20 still spring back to their original position.

Pillow 10 may also be used in combination with a removable slip cover. The slipcover may be constructed in a manner similar to cover 34, with an opening to permit it to be placed over pillow 10. Such an opening could be placed in top piece 40 or bottom piece 42, and in some cases, at the outer periphery 12. Also, one or more fasteners may be used to close the opening, such as a zipper, snaps, buttons, a hook and loop fastener material and the like.

Figure 5:
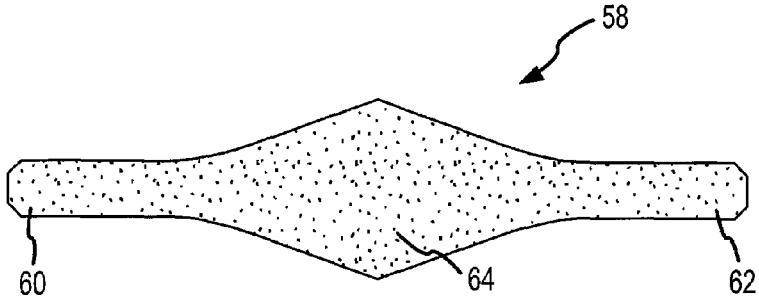
FIGS. 5-9 illustrate alternative stretch panels that may be used with support pillows or removable slip covers according to the invention.

The pillows of the invention may be used with center panels having a wide variety of shapes. Examples of such center panels are shown in FIGS. 5-9. Shown in FIG. 5 is a center panel 58 having ends 60 and 62 and a center section 64. Center panel 58 tapers outward along generally straight lines as the width increases at center section 64. As such, center section 64 has somewhat of a diamond shape.

Figure 6:
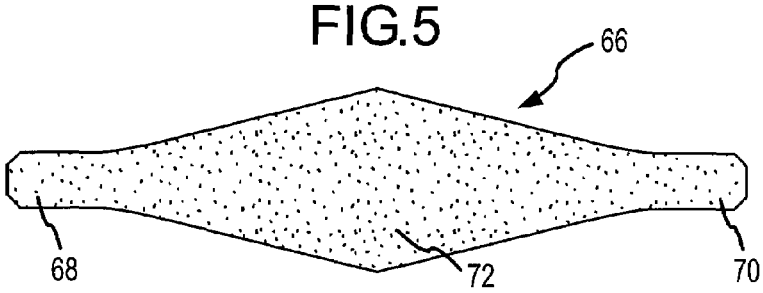

FIG. 6 illustrates a center panel 66 having ends 68 and 70 and a center section 72. Panel 66 is similar to panel 58 except that center section 64 does not include points at its widest portion.

Figure 7:
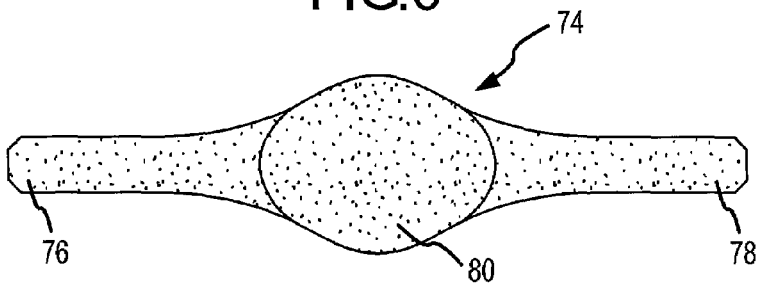

FIG. 7 illustrates a center panel 74 having ends 76 and 78 and a center section 80 which may be circular, elliptical or generally curved in geometry. Also, center panel 74 may be constructed of multiple pieces of fabric.

Figure 8:
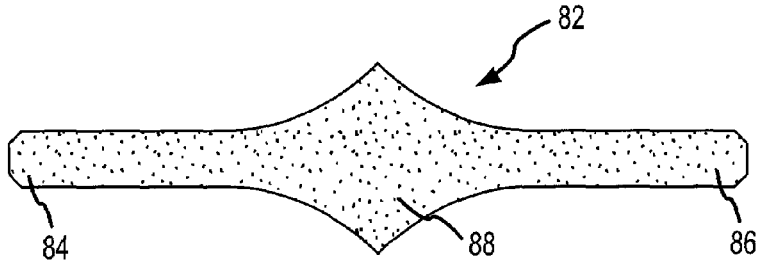

FIG. 8 illustrates a center panel 82 having ends 84 and 86 and a center section 88. Panel 82 increases in width from ends 84 and 86 to center section 88 to form a point at center section 88. Also, the edges of panel 82 curve inward at center section 88.

Figure 9:
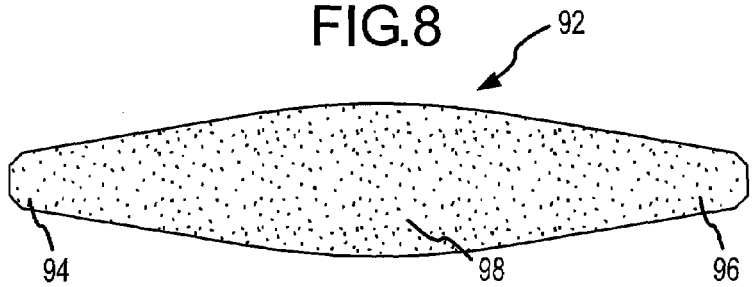

FIG. 9 illustrates a center panel 92 having ends 94 and 96 and a center section 98. The edges of center panel curve outward at center section 98 to form a gently curved surface at center section 98.

Figure 10:
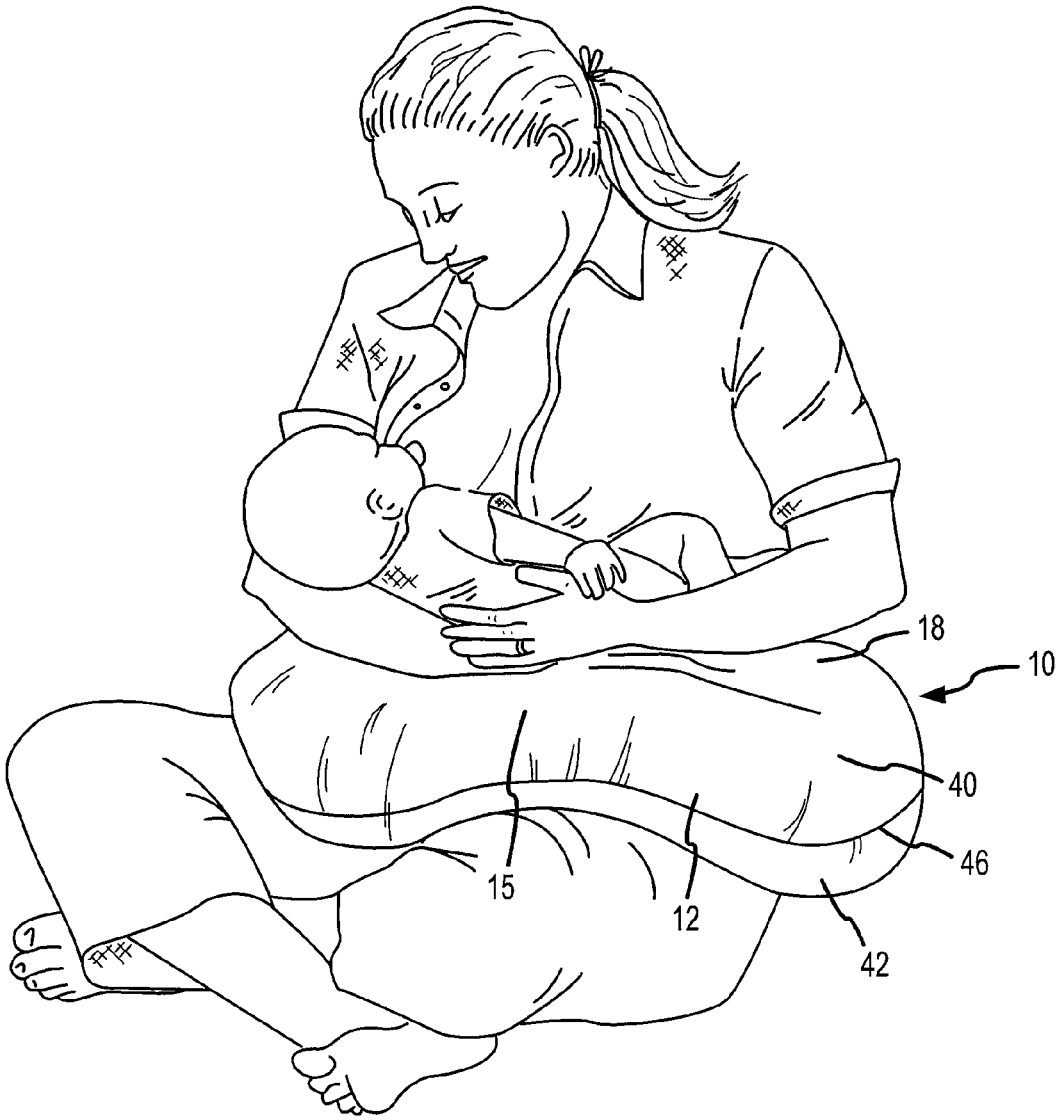
FIG. 10 illustrates the pillow of FIG. 1 used when nursing.
Figure 11:
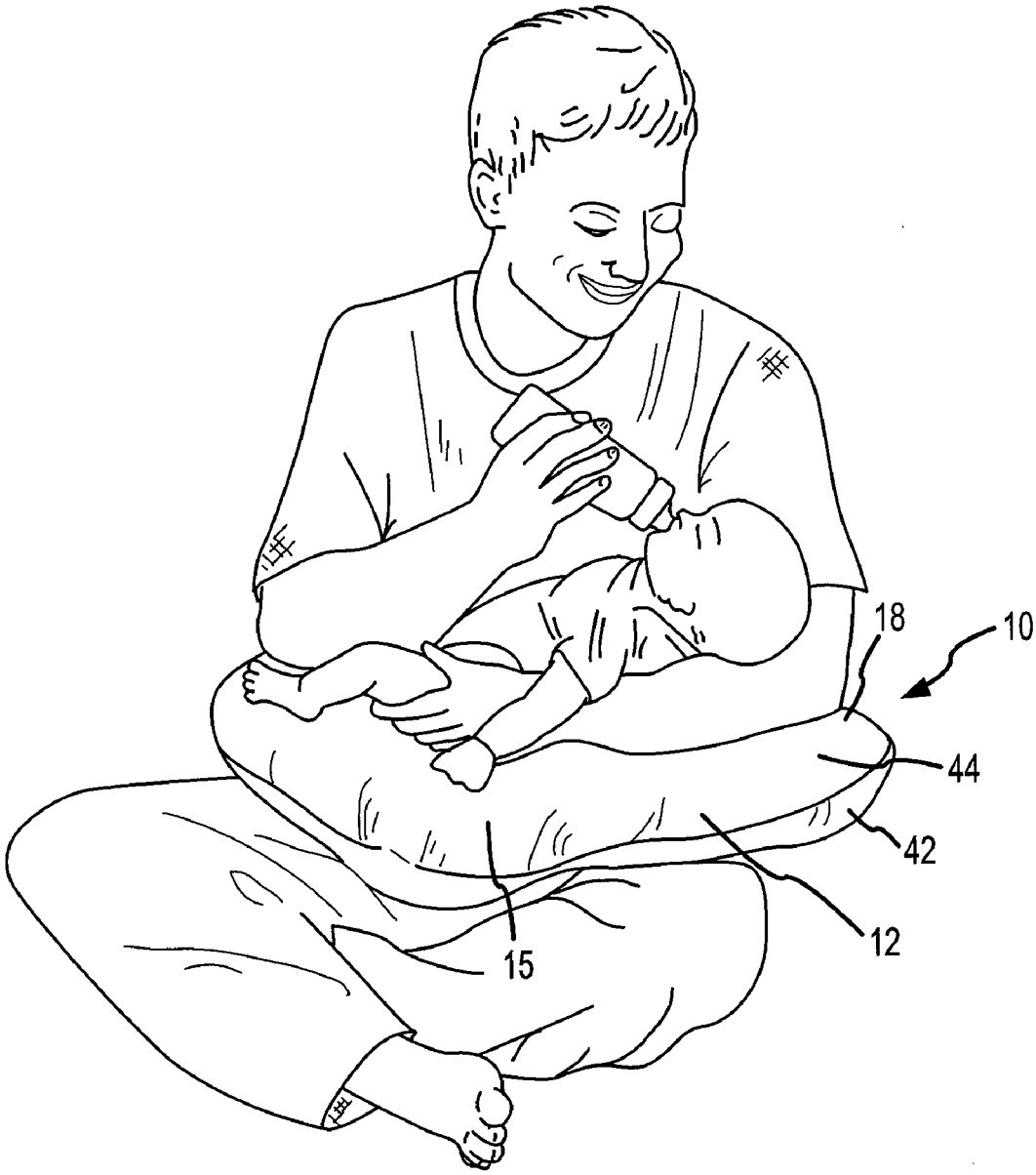
FIG. 11 illustrates the pillow of FIG. 1 used when feeding a baby.

FIGS. 10 and 11 illustrate the use of support pillow 10 to facilitate breast feeding or bottle feeding of a baby. To do so, pillow 10 may be placed about the torso and may conveniently rest on the legs. The baby may then be held on medial region 15 while feeding or holding the baby.

Figure 12:
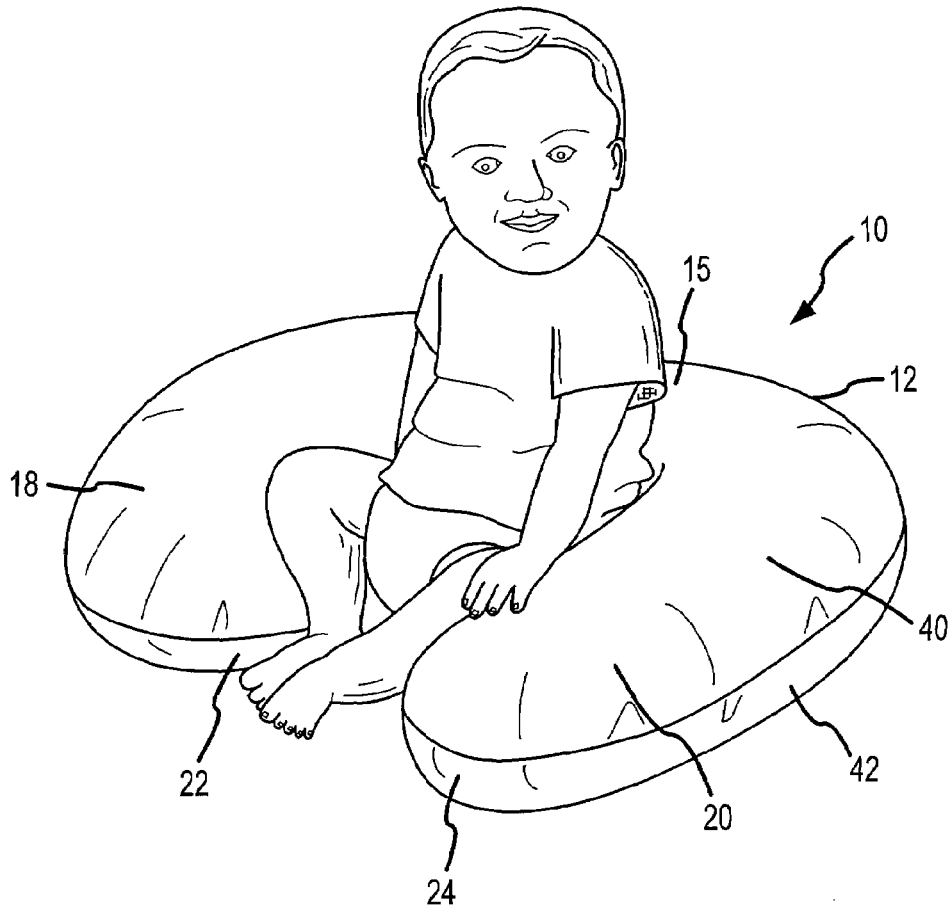
FIG. 12 illustrates the pillow of FIG. 1 when supporting a baby.

FIG. 12 is illustrates the use of support pillow 10 to maintain a baby in a sitting position. As shown, the baby is placed within well region 16, with the arms 18 and 20 and medial region 15 holding the baby upright. If needed, arms 18 and 20 may be separated to fit around the baby, while still being sufficiently resilient to snugly fit around the baby.

The invention has now been described in detail for purposes of clarity and understanding. However, it will be appreciated that certain changes and modifications may be practiced within the scope of the appended claims.

What is claimed is:

1. A support pillow, comprising:

a pillow body having a medial region and two opposing arms that form a well region, a first side and a second side, wherein the pillow body farther includes an outer periphery and an inner periphery outlining the well region, wherein the pillow body farther comprises a fill material and a cover enveloping the fill material, wherein the cover comprises:

a main section that extends about the first and second sides and the outer periphery, and a center panel coupled to the main section so as to be located along the inner periphery, wherein the center panel is constructed of a stretchable material and has variable outer dimensions;

wherein the center panel has a length aligned with the inner periphery and a width that is perpendicular to the length, wherein the width is larger at the medial region than at the opposing arms, wherein the width of the center panel at the medial region is in the range from about 2.5 inches to about 7.5 inches, wherein the length of the center panel is in the range from about 20 inches to about 28 inches, and wherein the width of the center panel along the opposing arms is in the range from about 1 inch to about 3.5 inches.

2. A pillow as in claim 1, wherein the main section comprises a pair of fabric pieces that are sewn together at the outer periphery, and wherein the center panel is sewn to the pair of fabric pieces.

3. A pillow as in claim 1, wherein the stretchable material is selected from a group consisting of a two-way stretch material, a four-way stretch material, a stretch twill, and a stretch cotton.

4. A pillow as in claim 1, wherein the stretchable material is configured to stretch at least about 20 percent in one direction.

5. A pillow as in claim 1, wherein the center panel is configured such that the pillow body is openable so that the arms are generally aligned with each other and such that the arms will spring back to within about 8 inches of each other.

6. A pillow as in claim 1, wherein the well has a diameter in the range from about 4 inches to about 12 inches when the arms are touching.

7. A pillow as in claim 1, wherein the center panel is configured to permit the arms to be separated so as to be at least perpendicular to the medial region with essentially no buckling of the main section of the cover.

8. A pillow as in claim 1, wherein the width of the center panel begins to increase within about 4 inches from the ends of the stretch panel.

9. A support pillow comprising:

a pillow body having a medial region and two opposing arms that form a well region, a first side and a second side, wherein the pillow body further includes an outer periphery and an inner periphery outlining the well region, wherein the pillow body further comprises a fill material and a cover enveloping the fill material, wherein the cover comprises:

a main section that extends about the first and second sides and the outer periphery, and a center panel coupled to the main section so as to be located along the inner periphery, wherein the center panel has a length aligned with the inner periphery and a width that is perpendicular to the length, and wherein the width of the center panel is greater at the medial region than along the arms, wherein the width of the center panel at the medial region is in the range from about 2.5 inches to about 7.5 inches, wherein the length of the center panel is in the range from about 20 inches to about 28 inches, and wherein the width of the center panel along the opposing arms is in the range from about 1 inch to about 3.5 inches.

10. A pillow as in claim 9, wherein the center panel is constructed of a stretchable material.

11. A pillow as in claim 10, wherein the stretchable material is selected from a group consisting of a two-way stretch material, a four-way stretch material, a stretch twill, and a stretch cotton.

12. A pillow as in claim 9, wherein the main section comprises a pair of fabric pieces that are sewn together at the outer periphery, and wherein the center panel is sewn to the pair of fabric pieces.

13. A pillow as in claim 10, wherein the stretchable material is configured to stretch at least about 20 percent in one direction.

14. A pillow as in claim 9, wherein the center panel is configured such that the pillow body is openable so that the arms are generally aligned with each other and such that the arms will spring back to within about 8 inches of each other.

15. A pillow as in claim 9, wherein the well has a diameter in the range from about 4 inches to about 12 inches when the arms are touching.

16. A pillow as in claim 9, wherein the central panel is configured to permit the arms to be separated so as to be at least perpendicular to the medial region with essentially no buckling of the main section of the cover.

17. A pillow as in claim 9, wherein the width of the center panel begins to increase within about 4 inches from the ends of the stretch panel.

18. A method for using a support pillow, comprising:

providing a support pillow comprising:

a pillow body having a medial region and two opposing arms that form a well region, a first side and a second side, wherein the pillow body further includes an outer periphery and an inner periphery outlining the well region, wherein the pillow body further comprises a fill material and a cover enveloping the fill material, wherein the cover comprises:

a main section that extends about the first and second sides and the outer periphery, and a stretch panel coupled to the main section so as to be located along the inner periphery, wherein the stretch panel is constructed of a stretchable material and has a width that increases at the medial region;

wherein the center panel has a length aligned with the inner periphery and a width that is perpendicular to the length, and wherein the width is larger at the medial region than at the opposing arms, wherein the width of the center panel at the medial region is in the range from about 2.5 inches to about 7.5 inches, wherein the length of the center panel is in the range from about 20 inches to about 28 inches, and wherein the width of the center panel along the opposing arms is in the range from about 1 inch to about 3.5 inches;

separating the arms from each other; and placing the support pillow about a user's torso.

* * * * *